US010000832B2

(12) United States Patent
Takabe et al.

(10) Patent No.: US 10,000,832 B2
(45) **Date of Patent: *Jun. 19, 2018**

(54) DUPLEX STAINLESS STEEL

(75) Inventors: Hideki Takabe, Tokyo (JP); Hisashi Amaya, Tokyo (JP); Kazuhiro Ogawa, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 112 days.

This patent is subject to a terminal disclaimer.

(21) Appl. No.: 14/342,039

(22) PCT Filed: Aug. 28, 2012

(86) PCT No.: PCT/JP2012/071725

§ 371 (c)(1),
(2), (4) Date: Feb. 28, 2014

(87) PCT Pub. No.: WO2013/035588

PCT Pub. Date: Mar. 14, 2013

(65) Prior Publication Data

US 2014/0212322 A1 Jul. 31, 2014

(30) Foreign Application Priority Data

Sep. 6, 2011 (JP) ..... 2011-194160

(51) Int. Cl.
*C22C 38/58* (2006.01)
*C21D 9/08* (2006.01)
(Continued)

(52) U.S. Cl.
CPC ..... *C22C 38/58* (2013.01); *C21D 6/004* (2013.01); *C21D 6/005* (2013.01); *C21D 9/08* (2013.01);
(Continued)

(58) Field of Classification Search
CPC ..... C22C 38/00; C22C 38/001; C22C 38/002; C22C 38/02; C22C 38/06; C22C 38/42;
(Continued)

(56) References Cited

U.S. PATENT DOCUMENTS

2005/0194073 A1* 9/2005 Hamano ..... C22C 38/001 148/608
2009/0098007 A1* 4/2009 Tsuge ..... C21C 5/005 420/38
(Continued)

FOREIGN PATENT DOCUMENTS

CN 101346486 1/2009
EP 2060648 * 5/2009 ..... C22C 38/00
(Continued)

OTHER PUBLICATIONS

WO 2011/102499 A1, Tsuge et al., published Aug. 25, 2011 (machine translation).*

*Primary Examiner* — Keith Walker
*Assistant Examiner* — John A Hevey
(74) *Attorney, Agent, or Firm* — Clark & Brody

(57) ABSTRACT

Provided is duplex stainless steel having high strength, SCC resistance and SSC resistance excellent in a high-temperature chloride environment, and capable of suppressing precipitation of a σ phase. The duplex stainless steel of the present embodiment includes, in mass %, of: C: at most 0.03%; Si: 0.2 to 1%; Mn: more than 5.0% to at most 10%; P: at most 0.040%; S: at most 0.010%; Ni: 4.5 to 8%; sol. Al: at most 0.040%; N: more than 0.2% to at most 0.4%; Cr: 24 to 29%; Mo: 0.5 to less than 1.5%; Cu: 1.5 to 3.5%; W: 0.05 to 0.2%; the balance being Fe and impurities, wherein the duplex stainless steel satisfies Formula (1): Cr+8Ni+Cu+Mo+W/2≥65 . . . (1), where a symbol of each element in Formula (1) represents a content of the element (in mass %).

14 Claims, 4 Drawing Sheets

(51) Int. Cl.

| | |
|---|---|
| ***C22C 38/00*** | (2006.01) |
| ***C22C 38/02*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/54*** | (2006.01) |
| ***C21D 6/00*** | (2006.01) |
| *C21D 9/50* | (2006.01) |

(52) U.S. Cl.
CPC ..... *C22C 38/00* (2013.01); *C22C 38/001* (2013.01); *C22C 38/002* (2013.01); *C22C 38/02* (2013.01); *C22C 38/06* (2013.01); *C22C 38/42* (2013.01); *C22C 38/44* (2013.01); *C22C 38/46* (2013.01); *C22C 38/54* (2013.01); *C21D 9/50* (2013.01); *C21D 2211/001* (2013.01); *C21D 2211/004* (2013.01); *C21D 2211/005* (2013.01)

(58) Field of Classification Search
CPC ..... C22C 38/44; C22C 38/46; C22C 38/54; C22C 38/58
See application file for complete search history.

(56) References Cited

U.S. PATENT DOCUMENTS

2013/0312880 A1* 11/2013 Motoya ..... C22C 38/001 148/607
2013/0315776 A1* 11/2013 Yamada ..... C22C 38/005 420/40

FOREIGN PATENT DOCUMENTS

| | | | | |
|---|---|---|---|---|
| JP | 05-132741 | | 5/1993 | |
| JP | 2002-339042 | | 11/2002 | |
| JP | 2003-171743 | | 6/2003 | |
| WO | WO 2008088282 | * | 7/2008 | ..... C22C 38/44 |
| WO | 2011/030709 | | 3/2011 | |
| WO | 2011/102499 | | 8/2011 | |
| WO | WO 2011/102499 A1 | * | 8/2011 | ..... C22C 38/58 |

* cited by examiner

DUPLEX STAINLESS STEEL

TECHNICAL FIELD

The present invention relates to stainless steel, more specifically, to duplex stainless steel.

BACKGROUND ART

Oil and natural gas produced from oil fields and gas fields contain associated gas. The associated gas contains corrosive gas, such as carbon dioxide gas ($CO_2$) and/or hydrogen sulfide ($H_2S$). Line pipes transport oil and natural gas containing the above corrosive gas. Consequently, in line pipes, stress corrosion cracking (SCC), sulfide stress cracking (SSC), and general corrosion cracking account for reduction in wall thickness may cause problems in some cases.

SCC and SSC cause rapid propagation of the cracking. Hence, SCC and SSC penetrate line pipes in a short time since they occur. In addition, SCC and SSC occur locally. For theses reasons, corrosion resistance, particularly, SCC resistance and SSC resistance are required in steel material for use in line pipes.

Duplex stainless steel has high corrosion resistance. Hence, duplex stainless steel is used as steel for line pipes.

High strengthening of steel pipes attains reduction in wall thickness of the steel pipes for the line pipes, resulting in reduction in production cost. In this sense, high strengthening is required in the duplex stainless steel for use in the line pipes. JP 2003-171743A (Patent Literature 1) and JP 5-132741A (Patent Literature 2) suggest duplex stainless steel having high strength.

Patent Literature 1 discloses the following: the duplex stainless steel of Patent Literature 1 contains Mo of at least 2.00% as well as W. Solid-solution strengthening of Mo and W enhances strength of the duplex stainless steel. The duplex stainless steel of Patent Literature 1 contains Cr of 22.00 to 28.00%, and Ni of 3.00 to 5.00%. This configuration enhances corrosion resistance of the duplex stainless steel.

Patent Literature 2 discloses the following: the duplex stainless steel of Patent Literature 2 contains Mo of at least 2.00% as well as W. In the duplex stainless steel, PREW=Cr+3.3 (Mo+0.5 W)+16N is at least 40. The contents of Mo and W enhance strength of the duplex stainless steel. PREW of at least 40 enhances corrosion resistance of the duplex stainless, as well.

DISCLOSURE OF THE INVENTION

Unfortunately, each duplex stainless steel disclosed in Patent Literature 1 and Patent Literature 2 has a high content of Mo. If the Mo content is high, a sigma phase (σ phase) is likely to be generated. The σ phase precipitates during producing and welding the steel. The σ phase is hard and brittle, which reduces toughness and corrosion resistance of the duplex stainless steel. Particularly, steel pipes for used in line pipes are welded on the site where the line pipes are installed. Hence, it is preferable to suppress precipitation of the σ phase particularly in the duplex stainless steel for use in line pipes.

As described above, high SCC resistance and high SSC resistance are required in an environment having accompanied gas containing carbon dioxide gas and/or hydrogen sulfide (referred to as a "chloride environment," hereinafter). Oil fields and gas fields that have been recently developed are located at a deep level. Oil fields and gas fields located at a deep level have a chloride environment whose temperature is 80° C. to 150° C. Consequently, in the duplex stainless steel for use in line pipes, SCC resistance and SSC resistance excellent even in such a high-temperature chloride environment are required.

An object of the present invention is to provide duplex stainless steel having high strength, SCC resistance and SSC resistance excellent in a high-temperature chloride environment, and capable of suppressing precipitation of the σ phase.

Duplex stainless steel according to the present invention comprises, in mass %, C: at most 0.03%; Si: 0.2 to 1%; Mn: more than 5.0% to at most 10%; P: at most 0.040%; S: at most 0.010%; Ni: 4.5 to 8%; sol. Al: at most 0.040%; N: more than 0.2% to at most 0.4%; Cr: 24 to 29%; Mo: 0.5 to less than 1.5%; Cu: 1.5 to 3.5%; W: 0.05 to 0.2%; the balance being Fe and impurities, and satisfies Formula (1): $Cr+8Ni+Cu+Mo+W/2 \geq 65$ . . . (1), where a symbol of each element in Formula (1) represents a content of the element (in mass %).

The duplex stainless steel according to the present invention has high strength, and SCC resistance and SSC resistance excellent in a high-temperature chloride environment. In addition, precipitation of the σ phase is suppressed.

The aforementioned duplex stainless steel may further comprise V: at most 1.5% instead of part of Fe.

The aforementioned duplex stainless steel may further comprise one or more types selected from a group of Ca: at most 0.02%, Mg: at most 0.020, and B: at most 0.02% instead of part of Fe.

BEST MODE FOR CARRYING OUT THE INVENTION

Figure 1:
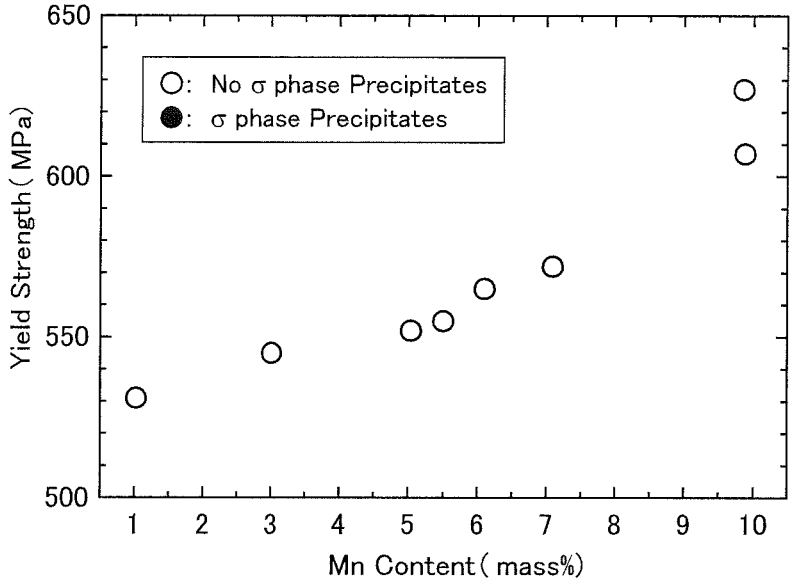
FIG. 1 is a drawing showing a relation among a Mn content, yield strength and precipitation of a σ phase in duplex stainless steel.

Hereinafter, an embodiment of the present invention will be described in detail with reference to drawings. Same or equivalent components in the drawings are denoted with the same reference numerals, and repeated explanation thereof is omitted. A symbol "%" for a content of each element means mass % unless otherwise mentioned.

The present inventors have conducted investigations and studies on strength, SCC resistance and SSC resistance in a high-temperature chloride environment, and suppression of a σ phase precipitation of duplex stainless steel. As a result, the present inventors have obtained the following findings.

(A) Mo enhances strength of steel, but encourages precipitation of the σ phase. Hence, it is preferable to suppress the Mo content to be as small as possible. W is expensive, and thus it is also preferable to suppress the W content to be as small as possible.

(B) As the Mo content and the W content are more reduced, the strength of the duplex stainless steel becomes more reduced. Hence, instead of increasing the Mo content and the W content, the Mn content is increased so as to enhance the strength of the duplex stainless steel.

Figure 2:
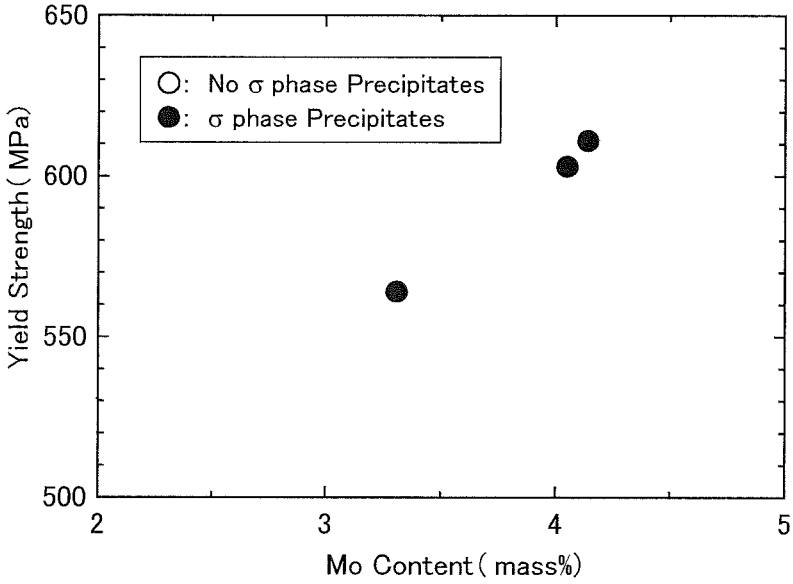
FIG. 2 is a drawing showing a relation among a Mo content, the yield strength and precipitation of the σ phase in the duplex stainless steel.

FIG. 1 is a drawing showing a relation among the Mn content, the yield strength, and the σ phase precipitation. FIG. 2 is a drawing showing a relation among the Mo content, the yield strength, and the σ phase precipitation. FIG. 1 and FIG. 2 are obtained based on a tensile test and a σ-phase area ratio measurement test in Example 1 and in Example 3, as described later. In FIG. 1 and FIG. 2, open marks "○" indicate that no σ phase was observed in the σ-phase area ratio measurement test, and solid marks "●" indicate that the σ phase was observed.

With reference to FIG. 1 and FIG. 2, as the Mo content becomes higher, the yield strength becomes greater, and similarly, as the Mn content becomes higher, the yield strength becomes greater in the duplex stainless steel. If the Mn content is more than 5.0%, the yield strength of the duplex stainless steel becomes at least 550 MPa, resulting in high strength.

If the Mo content is high, the σ phase is observed in the duplex stainless steel; to the contrary, no σ phase is observed in the duplex stainless steel even if the Mn content is high. Hence, the Mn content of more than 5.0% enhances strength of the duplex stainless, and also suppresses generation of the σ phase instead of using Mo and W.

(C) If the Mn content is more than 5.0%, a corrosion film formed on a surface of the duplex stainless steel becomes unstable in the high-temperature chloride environment. If the corrosion film becomes unstable, the SCC resistance becomes deteriorated in the high-temperature chloride environment.

In order to enhance the SCC resistance of the duplex stainless steel having the Mn content of more than 5.0%, the Ni content is defined to be at least 4.5%. Ni is effective for stabilizing the corrosion film in the duplex stainless steel having the Mn content of more than 5.0%. The Ni content of at least 4.5% enhances the SCC resistance of the duplex stainless steel having the Mn content of more than 5.0%.

(D) In order to enhance the SCC resistance of the duplex stainless steel having the Mn content of more than 5.0%, the duplex stainless steel preferably satisfies the following Formula (1) in addition to the above (C).

$$Cr+8Ni+Cu+Mo+W/2 \geq 65 \quad (1),$$

where, a symbol of each element in Formula (1) represents mass % of the element.

All of Cr, Ni, Mo, and W stabilize the corrosion film. F1 is defined to be F1=Cr+8Ni+Cu+Mo+W/2. If F1 satisfies Formula (1), a stable corrosion film can be formed even if the Mn content is more than 5.0%. Hence, the SCC resistance of the duplex stainless steel becomes high.

Figure 3:
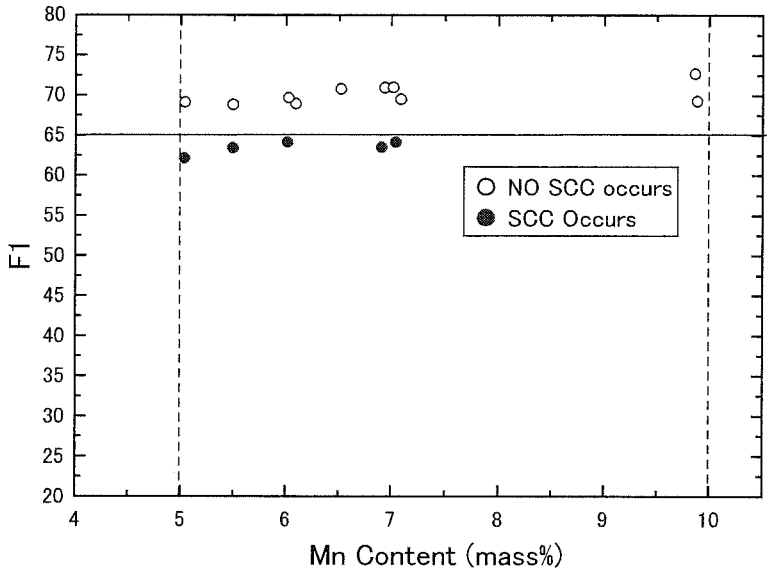
FIG. 3 is a drawing showing a relation among the Mn content, F1=Cr+8Ni+Cu+Mo+W/2, and SCC resistance.

FIG. 3 is a drawing showing a relation among the Mn content, F1, and the SCC resistance. FIG. 3 was obtained based on the result of the SCC test in Example 3 described later. In FIG. 3, open marks "○" indicate that no SCC was observed, and solid marks "●" indicate that SCC was observed.

With reference to FIG. 3, in the duplex stainless steel having the Mn content of more than 5.0%, if F1 is at least 65, excellent SCC resistance can be attained without relying on the content of Mn. On the other hand, if F1 value is less than 65, SCC occurs in the duplex stainless steel having the Mn content of at least 5.0%. Hence, in the case of the duplex stainless steel having the Mn content of at least 5.0%, excellent SCC resistance can be attained by satisfying Formula (1).

Based on the above findings, the present inventors have completed the duplex stainless steel according to the present embodiment. Hereinafter, the duplex stainless steel according to the present embodiment will be described in detail.

[Chemical Composition]

The duplex stainless steel according to the present invention includes the following chemical composition.

C: at Most 0.03%

Carbon (C) stabilizes an austenite phase in the steel, as similar to Nitrogen (N). On the other hand, if the C content is excessively high, coarse carbide is likely to precipitate, and the corrosion resistance of the steel, particularly, the SCC resistance thereof becomes deteriorated. Accordingly, the C content is defined to be at most 0.03%. The upper limit of the C content is preferably less than 0.03%, more preferably 0.02%, and further more preferably less than 0.02%.

Si: 0.2 to 1%

Silicon (Si) secures flowability of welding metal at the time of welding the duplex stainless steel to each other. Hence, generation of weld defects is suppressed. On the other hand, an excessively high Si content generates intermetallic compound represented by the σ phase. Accordingly, the Si content is defined to be 0.2 to 1%. The lower limit of the Si content is preferably more than 0.2%, more preferably 0.35%, and further more preferably 0.40%. The upper limit of the Si content is preferably less than 1%, more preferably 0.80%, and more preferably 0.65%.

Mn: more than 5.0% to at most 10%.

Manganese (Mn) enhances solubility of N in the steel. Hence, Mn suppresses precipitation of the σ phase as well as enhances strength of the steel. On the other hand, if the Mn content is excessively high, the corrosion resistance (SSC resistance and SCC resistance) of the steel becomes deteriorated. Hence, the Mn content is defined to be more than 5.0% to at most 10%. The lower limit of the Mn content is preferably 5.5%, and more preferably more than 6.0%. The preferable upper limit of the Mn content is less than 10%.

P: at Most 0.040%

Phosphorus (P) is an impurity. P deteriorates the corrosion resistance and toughness of the steel. Hence, the P content is preferably as small as possible. The P content is defined to be at most 0.040%. The P content is preferably less than 0.040%, more preferably at most 0.030%, and further more preferably at most 0.020%.

S: at Most 0.010%

Sulfur (S) is an impurity. S deteriorates hot workability of the steel. S generates sulfide, which initiates pitting. Accordingly, the S content is preferably as small as possible. The S content is defined to be at most 0.010%. The S content is preferably less than 0.010%, more preferably at most 0.007%, and further more preferably at most 0.002%.

Ni: 4.5 to 8%

Nickel (Ni) stabilizes the austenite phase in the steel. Ni enhances the corrosion resistance of the steel, as well. In the case of the Mn content of more than 5.0% as similar to the present embodiment, Ni stabilizes the corrosion film of the steel in the high-temperature chloride environment. On the other hand, the excessively high Ni content reduces the ratio of the ferrite phase in the duplex stainless steel. The intermetallic compound represented by the σ phase significantly precipitates, as well. Accordingly, the Ni content is defined to be 4.5% to 8%. The lower limit of the Ni content is preferably more than 4.5%, and more preferably more than 5%. The upper limit of the Ni content is preferably less than 8%, more preferably 7%, and further more preferably 6.5%.

Sol. Al: at Most 0.040%

Aluminum (Al) deoxidizes the steel. On the other hand, if the Al content is excessively high, Al combines with N in the steel to generate AlN, which deteriorates the corrosion resistance and the toughness of the steel. Accordingly, the Al content is defined to be at most 0.040%. The preferable lower limit of the Al content is 0.005%. The upper limit of the Al content is preferably less than 0.040%, more preferably 0.030%, and further more preferably 0.020%. In the present embodiment, the Al content denotes a content of acid-soluble Al (Sol. Al).

N: More than 0.2% to at Most 0.4%

Nitrogen (N) is a strong austenite former, and N enhances thermal stability, strength, and corrosion resistance (particularly pitting resistance) of the duplex stainless steel. On the other hand, an excessively high N content is likely to cause blow holes that are welding defects. In addition, coarse nitride is generated due to thermal influence at the time of welding, which deteriorates the toughness and the corrosion resistance of the steel. Accordingly, the N content is defined to be more than 0.2% to at most 0.4%. The upper limit of the N content is preferably less than 0.4%, more preferably 0.35%, and further more preferably 0.30%.

Cr: 24 to 29%

Chrome (Cr) enhances the corrosion resistance of the steel, and particularly enhances the SCC resistance thereof in the chloride environment. On the other hand, if the Cr content is excessively high, intermetallic compound represented by the σ phase significantly precipitates, which deteriorates hot workability and weldability of the steel. Accordingly, the Cr content is defined to be 24 to 29%. The lower limit of the Cr content is preferably more than 24%, more preferably 24.5%, and further more preferably 25%. The preferable upper limit of the Cr content is less than 29%.

Mo: 0.5 to Less than 1.5%

Molybdenum (Mo) enhances the SSC resistance and the SCC resistance of the steel, and particularly enhances the SSC resistance thereof. On the other hand, if the Mo content is excessively high, intermetallic compound represented by the σ phase significantly precipitates. Accordingly, the Mo content is defined to be 0.5 to less than 1.5%. The lower limit of the Mo content is preferably more than 0.5%, more preferably 0.7%, and further more preferably 0.8%. The upper limit of the Mo content is preferably 1.4%, and more preferably 1.2%.

Cu: 1.5 to 3.5%

Copper (Cu) strengthens a passivation film in the high-temperature chloride environment, and enhances the SCC resistance of the steel. Cu also suppresses generation of the σ phase at a boundary between a ferrite phase and an austenite phase. Specifically, extremely refined Cu precipitates in matrixes at the time of high heat input welding. Precipitating Cu becomes a site for nucleation of the σ phase. The precipitating Cu competes with the boundary between the ferrite phase and the austenite phase that is the original nucleation site of the σ phase. Consequently, the precipitation of the σ phase is suppressed at the boundary between the ferrite phase and the austenite phase. Cu enhances the strength of the steel. On the other hand, an excessively high Cu content rather deteriorates the hot workability of the steel. Accordingly, the Cu content is defined to be 1.5 to 3.5%. The lower limit of the Cu content is preferably more than 1.5%, and more preferably 2.0%. The upper limit of the Cu content is preferably less than 3.5%, and more preferably 3.0%.

W: 0.05 to 0.2%

Tungsten (W) enhances the SSC resistance and the SCC resistance of the steel. On the other hand, an excessively high W content rather saturates this effect, resulting in increase in production cost. Accordingly, the W content is defined to be 0.05% to 0.2%. The lower limit of the W content is preferably more than 0.05%. The upper limit of the W content is preferably less than 0.2%, and more preferably 0.15%.

The balance of the duplex stainless steel according to the present embodiment consists of iron (Fe) and impurities. The impurities herein denotes elements mixed from minerals or scraps used as row materials of the steel, or through an environment of the manufacturing process, and the like.

The duplex stainless steel according to the present embodiment may further comprise V instead of part of Fe.

V: at Most 1.5%

Vanadium (V) is an selective element. V enhances the corrosion resistance of the steel, and particularly enhances the corrosion resistance of the steel in an acidic environment. Even a slight content of V can attain this effect. On the other hand, an excessively high V content extremely increases the ratio of the ferrite phase in the steel, resulting in deterioration of the toughness and the corrosion resistance. Accordingly, the V content is defined to be at most 1.5%. The preferable lower limit of the V content is 0.05%.

The duplex stainless steel of the present embodiment further comprises one or more types of elements selected from a group of Ca, Mg, and B instead of part of Fe. Ca, Mg, and B enhance the hot workability of the steel.

Ca: at Most 0.02%

Mg: at Most 0.02%

B: at Most 0.02%

Calcium (Ca), magnesium (Mg), and boron (B) are all selective elements. All of Ca, Mg, and B enhance the hot workability of the steel. For example, at the time of producing a seamless steel pipe through the skew rolling process, high hot workability is required. In such a case, if one or more of Ca, Mg, and B are contained, the hot workability of the steel is enhanced. Even a slight content of any of these elements can attain this effect. On the other hand, if one or more of these elements has an excessively high content, oxide, sulfide, and intermetallic compound in the steel become increased. Oxide, sulfide, and intermetallic compound initiate pitting, which deteriorates the corrosion resistance of the steel. Accordingly, the Ca content is defined to be at most 0.02%, the Mg content is defined to be at most 0.02%, and the B content is defined to be at most 0.02%.

Each preferable lower limit of the Ca content, the Mg content, and the B content is 0.0001%. Each upper limit of the Ca content, the Mg content, and the B content is preferably less than 0.02%, more preferably 0.010%, and further more preferably 0.0050%.

[Formula (1)]

The chemical composition of the duplex stainless steel according to the present embodiment further satisfies Formula (1).

$$Cr+8Ni+Cu+Mo+W/2\geq 65 \quad (1),$$

where a symbol of each element in Formula (1) represents a content of the element (in mass %).

All of Cr, Ni, Cu, Mo, and W stabilize the corrosion film of the duplex stainless steel having the Mn content of more than 5.0% in the high-temperature chloride environment. Ni stabilizes the corrosion film the most among these elements.

Accordingly, the Ni content is multiplied by a coefficient of "8". Meanwhile, W has a small contribution ratio of stabilizing the corrosion film. Hence, the W content is multiplied by a coefficient of "½".

As shown in FIG. 3, if F1=Cr+8Ni+Cu+Mo+W/2 is at least 65, the SCC resistance is enhanced in the duplex stainless steel having the Mn content of more than 5.0%. On the other hand, if F1 is less than 65, the SCC resistance is reduced in the duplex stainless steel having the Mn content of more than 5.0% in the high-temperature chloride environment.

[Yield Strength]

The yield strength of the duplex stainless steel according to the present invention is at least 550 MPa. The yield strength is defined by a 0.2% proof stress. In the duplex stainless steel according to the present invention, while the contents of Mo and W that are elements for enhancing the strength are reduced, Mn that is also an element for enhancing the strength is contained at a content of more than 5.0%. Accordingly, it is possible to attain high strength of at least 550 MPa.

[Producing Method]

A producing method of the duplex stainless steel according to the present invention will be described, hereinafter. Duplex stainless steel is melted, which has the aforementioned chemical composition and satisfies Formula (1). The duplex stainless steel may be melted using an electric furnace, or using an Ar—$O_2$ gaseous-mixture bottom blowing decarburization furnace (AOD furnace). The duplex stainless steel may be melted using a vacuum oxygen decarburization furnace (VOD furnace). The melted duplex stainless steel may be produced into an ingot through the ingot-making process, or may be produced into a cast piece (slab, bloom, or billet) through the continuous casting process.

A duplex stainless steel material is produced using the produced ingot or cast piece. The duplex stainless steel material is a duplex stainless steel plate or a duplex stainless steel pipe, for example.

The duplex stainless steel plate may be produced in the following manner, for example. The produced ingot or slab is subjected to hot working so as to produce a duplex stainless steel plate. The hot working is hot forging or hot rolling, for example.

The duplex stainless steel pipe may be produced in the following manner, for example. Each produced ingot, slab, or bloom is subjected to hot working to produce a billet. The produced billet is subjected to hot working to produce a duplex stainless steel pipe. The hot working is piercing rolling with the Mannesmann process, for example. As the hot working, hot extrusion or hot forging may be carried out, instead. The produced duplex stainless steel pipe may be a seamless steel pipe or a welded steel pipe.

If the duplex stainless steel pipe is a welded steel pipe, the above duplex stainless steel plate may be bent into an open pipe, for example. Both the longitudinal ends of the open pipe are welded using a well-known method, such as a submerged arc welding or the like, thereby producing a welded steel pipe.

The produced duplex stainless steel material is subjected to solid solution heat treatment. Specifically, the duplex stainless steel material is charged in a heat treatment furnace, and is soaked at a well-known solid solution heat treatment temperature (900 to 1200° C.). After the soaking, the duplex stainless steel material is rapidly cooled by water cooling or the like.

In the above manner, the duplex stainless steel material is produced. The produced duplex stainless steel material has a yield strength of at least 550 Mpa. The duplex stainless steel material according to the present embodiment is an as-solid-solution heat-treated material.

Example 1

Duplex stainless steel plates including multiple kinds of chemical compositions were produced, and evaluations of the yield strength and the σ phase susceptibility were conducted on each produced duplex stainless steel plate.

[Test Method]

Each molten steel of the marks A to K having each chemical composition shown in Table 1 was produced using the vacuum furnace. An ingot was produced from each produced motel steel. The weight of each ingot was 150 kg.

TABLE 1

| | | Chemical Composition (Unit: Mass %, Balance: Fe and Impurities) | | | | | | | | | | | | | | | | |
|---|---|---|---|---|---|---|---|---|---|---|---|---|---|---|---|---|---|---|
| Category | Mark | C | Si | Mn | P | S | Ni | sol. Al | N | Cr | Mo | Cu | W | V | Ca | Mg | B | F1 |
| Inventive | A | 0.018 | 0.49 | 5.04 | 0.015 | 0.0009 | 5.06 | 0.015 | 0.225 | 25.09 | 1.00 | 2.48 | 0.10 | 0.11 | 0.0040 | — | 0.0018 | 69.1 |
| Example | B | 0.018 | 0.50 | 5.50 | 0.015 | 0.0010 | 5.06 | 0.015 | 0.224 | 24.90 | 1.00 | 2.46 | 0.10 | 0.11 | 0.0040 | — | 0.0018 | 68.9 |
| Steel | C | 0.018 | 0.49 | 6.10 | 0.015 | 0.0010 | 5.06 | 0.015 | 0.212 | 25.01 | 1.00 | 2.46 | 0.10 | 0.11 | 0.0040 | — | 0.0018 | 69.0 |
| | D | 0.016 | 0.50 | 7.09 | 0.017 | 0.0012 | 5.11 | 0.015 | 0.230 | 25.05 | 1.01 | 2.47 | 0.10 | 0.11 | 0.0042 | — | 0.0021 | 69.5 |
| | E | 0.017 | 0.48 | 9.88 | 0.014 | 0.0010 | 5.08 | 0.011 | 0.226 | 25.11 | 0.97 | 2.48 | 0.09 | 0.08 | 0.0038 | — | 0.0016 | 69.2 |
| | F | 0.015 | 0.49 | 9.86 | 0.012 | 0.0007 | 5.07 | 0.011 | 0.255 | 28.60 | 0.98 | 2.48 | 0.09 | — | — | — | 0.0011 | 72.7 |
| Comparative | G | 0.017 | 0.48 | 1.03 | 0.016 | 0.0008 | 5.05 | 0.009 | 0.187 | 25.22 | 1.01 | 2.48 | 0.10 | 0.11 | 0.0010 | — | 0.0019 | 69.2 |
| Example | H | 0.016 | 0.51 | 3.01 | 0.016 | 0.0008 | 5.02 | 0.014 | 0.203 | 25.02 | 1.01 | 2.48 | 0.10 | 0.11 | 0.0029 | — | 0.0017 | 68.7 |
| Steel | I | 0.016 | 0.48 | 0.48 | 0.015 | 0.0010 | 5.21 | 0.014 | 0.268 | 25.00 | 4.05 | 2.06 | 0.07 | — | — | — | — | 72.8 |
| | J | 0.016 | 0.48 | 0.49 | 0.016 | 0.0010 | 5.15 | 0.015 | 0.283 | 25.90 | 4.14 | 2.00 | 0.11 | — | 0.0050 | — | — | 73.3 |
| | K | 0.017 | 0.51 | 0.51 | 0.015 | 0.0007 | 5.30 | 0.013 | 0.211 | 25.07 | 3.31 | 2.01 | 0.12 | — | — | — | — | 72.9 |

F1 values (left side of Formula (1)) are recorded in the column "F1" of Table 1.

Each ingot was heated at 1250° C. The heated ingot was hot-forged into a steel plate having a thickness of 40 mm. Each steel plate was heated at 1250° C. The heated steel plate was hot-rolled into a steel plate having a thickness of 15 mm.

Each produced steel plate was subjected to solid solution heat treatment so as to produce a specimen steel plate. Specifically, each steel plate was soaked at a temperature of 1025 to 1070° C. for 30 minutes, and thereafter, the soaked steel plate was cooled with water. Each specimen steel plate was produced in the above manner.

[Tensile Test]

A round tensile specimen was collected from the specimen steel plate of each mark. Each round tensile specimen had a diameter of 4 mm in its straight portion, and a length of 20 mm. The longitudinal direction of the round tensile specimen was vertical to the rolling direction of the specimen steel plate. Each round tensile specimen was subjected to a tensile test at a normal temperature (25° C.) so as to measure the yield strength (MPa). The 0.2-% proof stress was defined as the yield strength.

[σ-Phase Area Ratio Measurement Test]

Generally, it is said that the σ phase precipitates at a temperature of 850 to 900° C. Accordingly, the σ phase susceptibility was evaluated for the specimen steel plate of each mark in the following manner. Each specimen steel plate was soaked at a temperature of 900° C. for ten minutes. A specimen having a surface vertical to the rolling direction of the specimen steel plate (referred to as a "observation surface", hereinafter) was collected from each soaked specimen steel plate. The observation surface of each collected specimen was mirror-polished as well as etched.

Using an optical microscope with 500× magnification, any four fields were selected in the etched cross section, and image analysis was made on each field. An area of each filed used in the image analysis was approximately 4000 $\mu m^2$. The area ratio (%) of the σ phase in each field was found through the image analysis. An average area ratio (%) obtained in the four fields was defined as the area ratio (%) of the σ phase in the specimen steel plate of each mark. If the area ratio of the σ phase was at least 1%, it was determined that the σ phase precipitated. If the area ratio of the σ phase was less than 1%, it was determined that no σ phase precipitated.

[Test Result]

Table 2 shows the test result.

TABLE 2

| Category | Mark | YS(MPa) | σ Phase Susceptibility |
|---|---|---|---|
| Inventive Example Steel | A | 552 | NF |
| | B | 555 | NF |
| | C | 565 | NF |
| | D | 572 | NF |
| | E | 607 | NF |
| | F | 627 | NF |
| Comparative Example Steel | G | 531 | NF |
| | H | 545 | NF |
| | I | 603 | F |
| | J | 611 | F |
| | K | 564 | F |

In Table 2, the column "YS (MPa)" shows the yield strength (MPa) of the specimen steel plate of each mark. The column "σ-phase susceptibility" shows the result of the σ-phase area ratio measurement test of the specimen steel plate of each mark. "NF" indicates that it was determined that no σ phase precipitated. "F" indicates that it was determined that the σ phase precipitated.

With reference to Table 2, each chemical composition of the marks A to F was within the range of the chemical composition of the present invention, and also each F1 value satisfied Formula (1). Hence, the yield strength of each specimen material of the marks A to F was at least 550 MPa, and no σ phase precipitated.

To the contrary, each Mn content of the marks G and H was less than the lower limit of the Mn content of the present invention. Hence, each yield strength of the marks G and H was less than 550 MPa.

Each Mn content of the marks I to K was less than the lower limit of the Mn content of the present invention. In addition, each Mo content of the marks I to K was more than the upper limit of the Mo content of the present invention. Hence, although each yield strength of the marks I to K was at least 550 MPa, the σ phase precipitated in all the specimen steel plates of the marks I to K.

Example 2

A welded joint was produced using each specimen steel plate of the marks C and D, and the marks I and J, and the σ phase susceptibility was evaluated for each welded joint.

[Test Method]

Figure 4A:
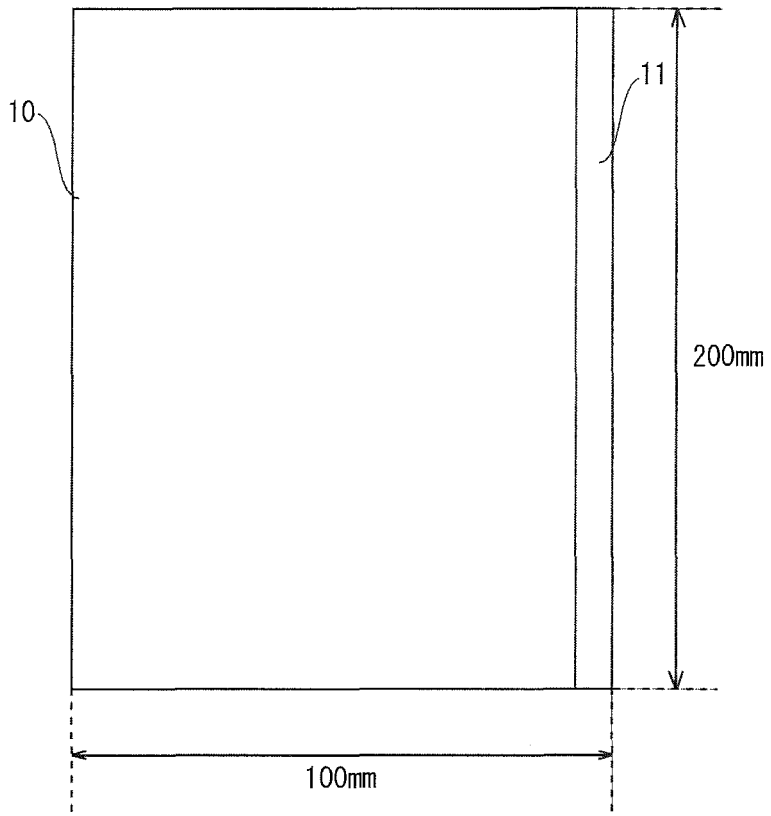
FIG. 4A is a plan view of a plate material produced in Example.
Figure 4B:
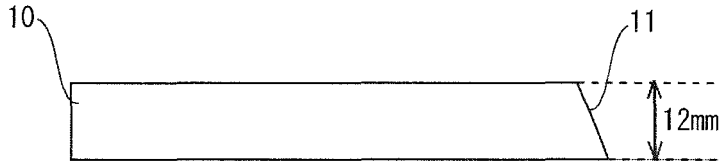
FIG. 4B is a front view of the plate material shown in FIG. 4A.

Four plate materials 10 shown in FIG. 4A and FIG. 4B were produced from each specimen steel plate of the marks C, D, I, and J. FIG. 4A is a plan view of each plate material 10, and FIG. 4B is a front view of each plate material 10. In FIG. 4A and FIG. 4B, each numerical value to which "mm" is attached denotes a dimension (unit: mm).

As shown in FIG. 4A, and FIG. 4B, each plate material 10 had a thickness of 12 mm, a width of 100 mm, and a length of 200 mm. The plate material 10 had a V-type groove face 11 whose groove angle was 30° at the longer side. Each plate material 10 was produced through machining.

Figure 5A:
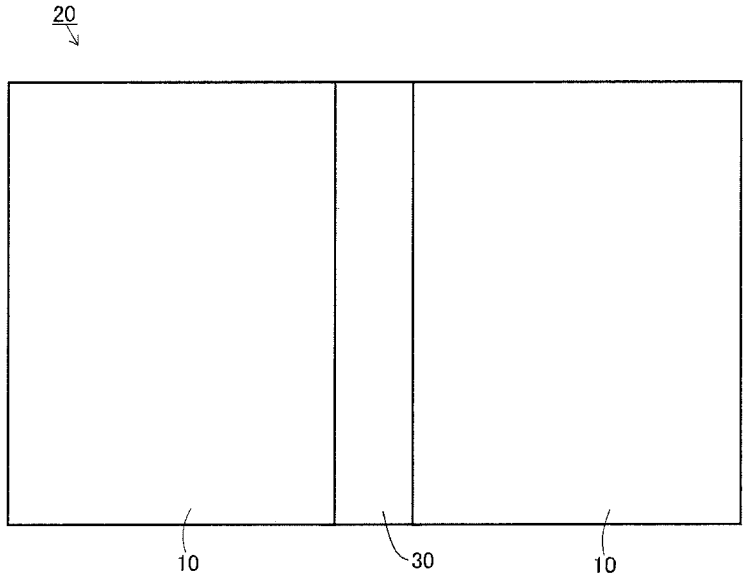
FIG. 5A is a plan view of a welded joint produced in Example.
Figure 5B:
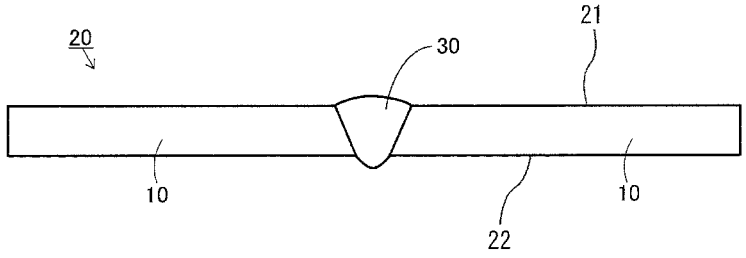
FIG. 5B is a front view of the welded joint shown in FIG. 5A.

Two of the produced plate materials 10 were disposed such that the V-type groove surface 11 of one plate material 10 opposed that of the other plate material 10. The two plate materials 10 were welded through the TIG welding, and two welded joints 20 shown in FIG. 5A and FIG. 5B were produced for each mark. FIG. 5A is a plan view of the welded joint 20, and FIG. 5B is a front view of the welded joint 20. Each welded joint 20 included a front face 21, and a back face 21, and also included a welded portion 30 at its central portion. The welded portion 30 was formed from the front face 21 through the multi-layer welding so as to extend in the longitudinal direction of the plate material 10. The welded portion 30 of each mark had each chemical composition shown in Table 3, and was formed using a welding material having an outer diameter of 2 mm.

TABLE 3

| Chemical Composition (Unit: Mass %, Balance: Fe and Impurities) | | | | | | | | | | | |
|---|---|---|---|---|---|---|---|---|---|---|---|
| C | Si | Mn | P | S | Ni | sol. Al | Cr | Mo | Cu | W | B |
| 0.02 | 0.31 | 0.52 | 0.007 | 0.002 | 9.3 | 0.003 | 25.3 | 2.95 | 0.5 | 2.02 | 0.0013 |

Of the two welded joints 20 of each mark, one welded joint 20 had heat input of 15 kJ/cm in the TIG welding. The other welded joint 20 had heat input of 35 kJ/cm in the TIG welding.

[σ-Phase Area Ratio Measurement Test]

The welded joint 20 of each test number was cut in the longitudinal direction of the welded portion 30, and also in the vertical direction to the front face 21. After the cutting, the cross section of the welded joint 20 was mirror-polished, and etched. After the etching, using the optical microscope with 500× magnification, four fields were selected in a welding heat affected zone (HAZ) in the vicinity of the welded portion included in the etched cross section, and image analysis was conducted on each field. The area of each filed used in the image analysis was approximately 40000 $\mu m^2$. The area ratio (%) of the σ phase in each field (HAZ) was found through the image analysis. The average area ratio (%) in these four fields was defined as the area ratio (%) of the σ phase within the HAZ of the test number of interest. If the area ratio of the σ phase was at least 1%, it was determined that the σ phase precipitated. If the area ratio of the σ phase was less than 1%, it was determined that no σ phase precipitated.

[Test Result]

Table 4 shows the test result.

TABLE 4

| Category | Mark | Heat Input 15 kJ/cm | Heat Input 35 kJ/cm |
|---|---|---|---|
| Inventive | C | NF | NF |
| Example Steel | D | NF | NF |
| Comparative | I | F | F |
| Example Steel | J | F | F |

In Table 4, the column "15 kJ/cm" in the column "Heat Input" shows the test result of each mark whose heat input of the TIG welding was 15 kJ/cm. The column "35 kJ/cm" in the column "Heat Input" shows the test result of each mark whose heat input of the TIG welding was 35 kJ/cm. "NF" in each column indicates that the area ratio of the σ phase was less than 1%, and no σ phase precipitated. "F" in each column indicates that the area ratio of the σ phase was at least 1%, and the σ phase precipitated.

With reference to Table 4, the chemical compositions of the mark C and the mark D were within the range of the chemical composition of the present invention, and the F1 value satisfied Formula (1). Hence, no σ phase precipitated in the HAZ at the both heat inputs of the TIG welding (15 kJ/cm and 35 kJ/cm).

To the contrary, each Mo content of the mark I and the mark J was more than the upper limit of the Mo content of the present invention. Hence, the σ phase precipitated in the HAZ at each heat input of the TIG welding (15 kJ/cm, and 35 kJ/cm).

Example 3

As similar to Example 1, multiple duplex stainless steel plates having multiple types of chemical compositions were produced. The yield strength, the existence of the σ phase, the SSC resistance, and the SCC resistance were evaluated for each of the produced duplex stainless steel plates.

[Test Method]

Each molten steel of the marks A to L, the marks M to Z, and the marks AA to AC having each chemical composition shown in Table 5 was produced using a vacuum furnace. An ingot was produced from each molten steel. The mass of each ingot was 150 kg.

TABLE 5

| | | Chemical Composition (Unit: Mass %, Balance: Fe and Impurities) | | | | | | | | | | | | | | | | |
|---|---|---|---|---|---|---|---|---|---|---|---|---|---|---|---|---|---|---|
| Category | Mark | C | Si | Mn | P | S | Ni | sol. Al | N | Cr | Mo | Cu | W | V | Ca | Mg | B | F1 |
| Inventive | A | 0.018 | 0.49 | 5.04 | 0.015 | 0.0009 | 5.06 | 0.015 | 0.225 | 25.09 | 1.00 | 2.48 | 0.10 | 0.11 | 0.0040 | — | 0.0018 | 69.1 |
| Example | B | 0.018 | 0.50 | 5.50 | 0.015 | 0.0010 | 5.06 | 0.015 | 0.224 | 24.90 | 1.00 | 2.46 | 0.10 | 0.11 | 0.0040 | — | 0.0018 | 68.9 |
| Steel | C | 0.018 | 0.49 | 6.10 | 0.015 | 0.0010 | 5.06 | 0.015 | 0.212 | 25.01 | 1.00 | 2.46 | 0.10 | 0.11 | 0.0040 | — | 0.0018 | 69.0 |
| | D | 0.016 | 0.50 | 7.09 | 0.017 | 0.0012 | 5.11 | 0.015 | 0.230 | 25.05 | 1.01 | 2.47 | 0.10 | 0.11 | 0.0042 | — | 0.0021 | 69.5 |
| | E | 0.017 | 0.48 | 9.88 | 0.014 | 0.0010 | 5.08 | 0.011 | 0.226 | 25.11 | 0.97 | 2.48 | 0.09 | 0.08 | 0.0038 | — | 0.0016 | 69.2 |
| | F | 0.015 | 0.49 | 9.86 | 0.012 | 0.0007 | 5.07 | 0.011 | 0.255 | 28.60 | 0.98 | 2.48 | 0.09 | — | — | — | 0.0011 | 72.7 |
| | L | 0.015 | 0.49 | 7.02 | 0.018 | 0.0007 | 5.07 | 0.014 | 0.214 | 26.85 | 0.98 | 2.48 | 0.09 | 0.11 | 0.0007 | — | 0.0013 | 70.9 |
| | M | 0.015 | 0.49 | 6.52 | 0.016 | 0.0007 | 5.07 | 0.012 | 0.215 | 26.70 | 0.98 | 2.48 | 0.09 | 0.11 | — | 0.0008 | — | 70.8 |
| | N | 0.015 | 0.49 | 7.01 | 0.018 | 0.0007 | 5.07 | 0.011 | 0.214 | 26.81 | 0.98 | 2.48 | 0.09 | — | — | — | — | 70.9 |
| | O | 0.015 | 0.49 | 6.94 | 0.016 | 0.0007 | 5.07 | 0.013 | 0.211 | 26.85 | 0.98 | 2.48 | 0.09 | — | 0.0007 | — | — | 70.9 |
| | P | 0.015 | 0.49 | 7.02 | 0.018 | 0.0007 | 5.07 | 0.014 | 0.220 | 26.90 | 0.98 | 2.48 | 0.09 | 0.08 | — | — | — | 71.0 |
| | Q | 0.018 | 0.50 | 6.03 | 0.015 | 0.0010 | 5.10 | 0.015 | 0.212 | 25.01 | 1.46 | 2.42 | 0.09 | 0.11 | 0.0038 | — | 0.0018 | 69.7 |
| | R | 0.015 | 0.49 | 6.98 | 0.015 | 0.0007 | 7.86 | 0.011 | 0.253 | 27.01 | 0.98 | 2.48 | 0.11 | — | 0.0013 | — | 0.0011 | 93.4 |
| Com- | S | 0.015 | 0.50 | 1.00 | 0.014 | 0.0009 | 5.00 | 0.020 | 0.150 | 25.00 | 0.40 | 2.00 | 0.10 | 0.10 | — | — | — | 67.5 |
| parative | T | 0.015 | 0.49 | 6.02 | 0.015 | 0.0010 | 3.04 | 0.019 | 0.224 | 24.60 | 1.00 | 2.01 | 0.08 | 0.10 | — | — | — | 52.0 |
| Example | U | 0.016 | 0.46 | 7.11 | 0.015 | 0.0008 | 2.01 | 0.023 | 0.208 | 24.90 | 1.01 | 2.02 | 0.08 | 0.11 | — | — | — | 44.1 |
| Steel | V | 0.015 | 0.48 | 6.08 | 0.013 | 0.0008 | 1.51 | 0.023 | 0.262 | 25.00 | 1.00 | 2.01 | 0.10 | 0.09 | — | — | — | 40.1 |
| | W | 0.036 | 0.68 | 6.04 | 0.016 | 0.0010 | 1.49 | 0.027 | 0.238 | 21.90 | 0.41 | 0.53 | 0.10 | 0.10 | — | — | — | 34.8 |
| | X | 0.036 | 0.68 | 6.02 | 0.016 | 0.0010 | 5.00 | 0.027 | 0.238 | 21.88 | 0.52 | 1.52 | 0.10 | 0.10 | — | — | — | 64.0 |
| | Y | 0.016 | 0.48 | 5.04 | 0.016 | 0.0008 | 4.51 | 0.015 | 0.196 | 24.05 | 0.52 | 1.52 | 0.06 | 0.11 | 0.0025 | — | 0.0012 | 62.2 |
| | Z | 0.018 | 0.48 | 5.50 | 0.015 | 0.0009 | 4.58 | 0.015 | 0.189 | 24.60 | 0.60 | 1.60 | 0.06 | 0.07 | 0.0026 | — | 0.0012 | 63.5 |
| | AA | 0.018 | 0.51 | 6.02 | 0.015 | 0.0008 | 4.71 | 0.014 | 0.214 | 24.20 | 0.58 | 1.70 | 0.06 | 0.08 | 0.0040 | — | 0.0014 | 64.2 |
| | AB | 0.018 | 0.49 | 7.05 | 0.015 | 0.0007 | 4.64 | 0.014 | 0.201 | 24.10 | 1.00 | 1.90 | 0.10 | 0.11 | 0.0033 | — | 0.0015 | 64.2 |
| | AC | 0.015 | 0.47 | 6.91 | 0.012 | 0.0006 | 4.56 | 0.013 | 0.220 | 24.45 | 0.98 | 1.56 | 0.08 | — | — | — | — | 63.5 |

A specimen steel plate of each mark was produced under the same producing condition as that of Example 1. The yield strength (MPa) of the specimen steel plate of each mark was found in the same manner as that in Example 1. The σ-phase area ratio measurement test was conducted on the specimen steel plate of each mark in the same manner as that in Example 1.

The following SCC and SSC tests were conducted on the specimen steel plate of each mark, and the SCC resistance and the SSC resistance of the specimen steel plate of each mark were evaluated.

[SCC Test]

A 4-point bending test specimen (referred to simply as a "specimen", hereinafter) was collected from the specimen steel plate of each mark. Each specimen had a length of 75 mm, a width of 10 mm, and a thickness of 2 mm. The longitudinal direction of the specimen was vertical to the rolling direction of the specimen steel plate. Each specimen was bent by 4-point bending. In compliance with ASTM G39, deflection for each specimen was determined in such a manner that the stress applied to each specimen become equal to the 0.2% proof stress of this specimen.

An autoclave having a temperature of 150° C. where $CO^2$ at 3 MPa was pressurized and enclosed was prepared. Each specimen to which bend was applied was immersed in an NaCl solution of 25% in mass % for 720 hours in this autoclave. After 720 hours had passed, it was evaluated whether or not cracking was generated in each specimen. Specifically, the cross section of each specimen at a portion where tensile stress was applied was observed using the optical microscope with 100× magnification so as to visually determine whether or not there is any cracking.

[SSC Test]

A 4-point bending test specimen was collected from the specimen steel plate of each mark in the same manner as that of the SCC test. Each specimen was bent by 4-point bending in the same manner as that of the SCC test.

An autoclave having a temperature of 90° C. where CO2 at 3 MPa and $H_2S$ at 0.003 MPa were pressurized and enclosed was prepared. Each specimen to which the bend was applied was immersed in the autoclave in an NaCl solution of 5% in mass % for 720 hours. After 720 hours had passed, it was evaluated whether or not cracking was generated in each specimen in the same manner as that of the SCC test.

[Test Result]

Table 6 shows the test result.

TABLE 6

| Category | Mark | YS(MPa) | σ Phase Susceptibility | SCC Resistance | SSC Resistance |
|---|---|---|---|---|---|
| Inventive Example Steel | A | 552 | NF | NF | NF |
| | B | 555 | NF | NF | NF |
| | C | 565 | NF | NF | NF |
| | D | 572 | NF | NF | NF |
| | E | 607 | NF | NF | NF |
| | F | 627 | NF | NF | NF |
| | L | 626 | NF | NF | NF |
| | M | 626 | NF | NF | NF |
| | N | 626 | NF | NF | NF |
| | O | 626 | NF | NF | NF |
| | P | 626 | NF | NF | NF |
| | Q | 593 | NF | NF | NF |
| | R | 622 | NF | NF | NF |
| Comparative Example Steel | S | 512 | NF | F | F |
| | T | 589 | NF | F | NF |
| | U | 658 | NF | F | NF |
| | V | 625 | NF | F | NF |
| | W | 507 | NF | F | F |
| | X | 556 | NF | F | NF |
| | Y | 553 | NF | F | NF |
| | Z | 556 | NF | F | NF |
| | AA | 560 | NF | F | NF |
| | AB | 569 | NF | F | NF |
| | AC | 618 | NF | F | NF |

In Table 6, the column "SCC Resistance" shows the evaluation result of the SCC test. The column "SSC Resistance" shows the evaluation result of the SSC test. In each column, "NF" indicates that no cracking was observed. "F" indicates that cracking was observed.

With reference to Table 6, each chemical composition of the marks A to F and the marks L to R was within the range of the chemical composition of the present invention, and the F1 value also satisfied Formula (1). Hence, the yield strength was at least 550 MPa, and no σ phase precipitated. As a result, no SCC and no SSC were observed in these specimen steel plates.

To the contrary, the Mn content of the mark S was less than the lower limit of the Mn content of the present invention. Hence, the yield strength was less than 550 MPa. The N content of the mark S was also less than the lower limit of the N content of the present invention. Hence, pitting occurred in the SCC test, and SCC was observed in the SCC test. In addition, The Mo content of the mark S was also less than the lower limit of the Mo content of the present invention. Hence, SSC was observed in the SSC test.

Each Ni content of the marks T to V was less than the lower limit of the Ni content of the present invention, and the F1 value did not satisfy Formula (1). Hence, SCC was observed in the SCC test.

The Cu content of the mark W was less than the lower limit of the Cu content of the present invention. Hence, the yield strength of the mark W was less than 550 MPa. In addition, the Mo content of the mark W was less than the lower limit of the Mo content of the present invention. Hence, SSC was observed in the SSC test. In the mark W, the Ni and Cr contents were less than the Ni and Cr contents of the present invention, and the F1 value did not satisfy Formula (1). The C content was more than the C content of the present invention. Hence, in the mark W, SCC was observed in the SCC test. It can be considered that the Ni content and the Cr content were excessively low, and excessive C generated Cr carbide in the mark W, and thus the corrosion film became unstable, and SCC occurred.

The Cr content of the mark X was less than the Cr content of the present invention, and the F1 value did not satisfy Formula (1). In the mark X, the C content was more than the C content of the present invention. Hence, SCC was observed in the SCC test in the mark X. In the mark X, it can be considered that the Cr content was excessively low, and excessive C generated Cr carbide, and thus the corrosion film became unstable, and SCC occurred.

Each N content of the mark Y and the mark Z was less than the lower limit of the N content of the present invention, and the F1 value did not satisfy Formula (1). Hence, pitting was generated, and SCC was observed in the SCC test.

Each chemical composition of the mark AA to the mark AC was within the range of the chemical composition of the present invention. The F1 value of each mark did not satisfy Formula (1), though. Hence, in the marks AA to the mark AC, SCC was observed in the SCC test. It can be considered that Formula (1) was not satisfied in these marks AA to AC, and thus the corrosion film became unstable, resulting in generation of SCC.

The embodiment of the present invention has been described above, but the aforementioned embodiment was merely exemplified for embodying the present invention. Accordingly, the present invention is not limited to the aforementioned embodiment, and the aforementioned embodiment may be appropriately modified to be carried out without departing from the spirit and scope of the present invention.

The invention claimed is:

1. Duplex stainless steel consisting of, in mass %,
C: at most 0.03%;
Si: 0.2 to 1%;
Mn: 6.1 to 10%;
P: at most 0.040%;
S: at most 0.010%;
Ni: 4.5 to 8%;
sol. Al: at most 0.040%;
N: more than 0.2% to at most 0.4%;
Cr: 26.85 to 29%;
Mo: 0.5 to less than 1.5%;
Cu: 1.5 to 3.5%;
W: 0.05 to 0.2%;
the balance being Fe and impurities,
wherein
the duplex stainless steel has a yield strength of at least 550 MPa, and
the duplex stainless steel satisfies Formula (1):

$$Cr+8Ni+Cu+Mo+W/2 \geq 65 \quad (1),$$

where a symbol of each element in Formula (1) represents a content of the element (in mass %).

2. Duplex stainless steel consisting of, in mass %,
C: at most 0.03%;
Si: 0.2 to 1%;
Mn: 6.1 to 10%;
P: at most 0.040%;
S: at most 0.010%;
Ni: 4.5 to 8%;
sol. Al: at most 0.040%;
N: more than 0.2% to at most 0.4%;
Cr: 26.85 to 29%;
Mo: 0.5 to less than 1.5%;
Cu: 1.5 to 3.5%;
W: 0.05 to 0.2%;
V: at most 1.5%;
the balance being Fe and impurities,
wherein
the duplex stainless steel has a yield strength of at least 550 MPa, and
the duplex stainless steel satisfies Formula (1):

$$Cr+8Ni+Cu+Mo+W/2 \geq 65 \quad (1),$$

where a symbol of each element in Formula (1) represents a content of the element (in mass %).

3. Duplex stainless steel consisting of, in mass %,
C: at most 0.03%;
Si: 0.2 to 1%;
Mn: 6.1 to 10%;
P: at most 0.040%;
S: at most 0.010%;
Ni: 4.5 to 8%;
sol. Al: at most 0.040%;
N: more than 0.2% to at most 0.4%;
Cr: 26.85 to 29%;
Mo: 0.5 to less than 1.5%;
Cu: 1.5 to 3.5%;
W: 0.05 to 0.2%;
one or more types selected from a group of Ca: at most 0.02%, Mg: at most 0.02%, and B: at most 0.02% instead of part of Fe;
the balance being Fe and impurities,
wherein
the duplex stainless steel has a yield strength of at least 550 MPa, and
the duplex stainless steel satisfies Formula (1):

$$Cr+8Ni+Cu+Mo+W/2 \geq 65 \quad (1),$$

where a symbol of each element in Formula (1) represents a content of the element (in mass %).

4. Duplex stainless steel consisting of, in mass %,
C: at most 0.03%;
Si: 0.2 to 1%;
Mn: 6.1 to 10%;
P: at most 0.040%;
S: at most 0.010%;
Ni: 4.5 to 8%;
sol. Al: at most 0.040%;
N: more than 0.2% to at most 0.4%;
Cr: 26.85 to 29%;
Mo: 0.5 to less than 1.5%;
Cu: 1.5 to 3.5%;
W: 0.05 to 0.2%;
V: at most 1.5%;
one or more types selected from a group of Ca: at most 0.02%, Mg: at most 0.02%, and B: at most 0.02% instead of part of Fe;
the balance being Fe and impurities,
wherein
the duplex stainless steel has a yield strength of at least 550 MPa, and
the duplex stainless steel satisfies Formula (1):

$$Cr+8Ni+Cu+Mo+W/2 \geq 65 \quad (1),$$

where a symbol of each element in Formula (1) represents a content of the element (in mass %).

5. The duplex stainless steel according to claim 1, wherein the Ni content is 4.5 to 6.5 mass %.

6. The duplex stainless steel according to claim 1, wherein the N content is more than 0.2 mass % to at most 0.35 mass %.

7. The duplex stainless steel according to claim 1, wherein the duplex stainless steel is a steel pipe.

8. The duplex stainless steel according to claim 2, wherein the duplex stainless steel is a steel pipe.

9. The duplex stainless steel according to claim 3, wherein the duplex stainless steel is a steel pipe.

10. The duplex stainless steel according to claim 4, wherein the duplex stainless steel is a steel pipe.

11. The duplex stainless steel according to claim 1, wherein the duplex stainless steel is a line pipe.

12. The duplex stainless steel according to claim 2, wherein the duplex stainless steel is a line pipe.

13. The duplex stainless steel according to claim 3, wherein the duplex stainless steel is a line pipe.

14. The duplex stainless steel according to claim 4, wherein the duplex stainless steel is a line pipe.

* * * * *